US007461795B2

(12) United States Patent
Magel

(10) Patent No.: US 7,461,795 B2
(45) Date of Patent: Dec. 9, 2008

(54) FUEL INJECTION SYSTEM FOR INTERNAL COMBUSTION ENGINES

(75) Inventor: Hans-Christoph Magel, Pfullingen (DE)

(73) Assignee: Robert Bosch GmbH, Stuttgart (DE)

( * ) Notice: Subject to any disclaimer, the term of this patent is extended or adjusted under 35 U.S.C. 154(b) by 380 days.

(21) Appl. No.: 10/532,493

(22) PCT Filed: Jun. 30, 2003

(86) PCT No.: PCT/DE03/02174

§ 371 (c)(1),
(2), (4) Date: Apr. 25, 2005

(87) PCT Pub. No.: WO2004/040117

PCT Pub. Date: May 13, 2004

(65) Prior Publication Data

US 2006/0049284 A1 Mar. 9, 2006

(30) Foreign Application Priority Data

Oct. 25, 2002 (DE) ..... 102 49 840

(51) Int. Cl.
*F02M 47/02* (2006.01)
*B05B 1/30* (2006.01)

(52) U.S. Cl. ..... 239/88; 239/533.9; 239/584; 239/585.5

(58) Field of Classification Search ..... 239/88, 239/89, 91, 92, 95, 533.2, 533.3, 533.8, 533.9, 239/585.1–585.5, 584
See application file for complete search history.

(56) References Cited

U.S. PATENT DOCUMENTS

| | | | | |
|---|---|---|---|---|
| 4,979,674 | A | 12/1990 | Taira et al. | |
| 5,413,076 | A | 5/1995 | Konigswieser et al. | |
| 6,443,129 | B1 * | 9/2002 | Boecking | 123/446 |
| 6,634,336 | B1 | 10/2003 | Kropp | |
| 6,997,392 | B2 * | 2/2006 | Klugl et al. | 239/89 |
| 2003/0127539 | A1 | 7/2003 | Braun et al. | |

FOREIGN PATENT DOCUMENTS

| | | | |
|---|---|---|---|
| DE | 43 11 627 | A1 | 10/1994 |
| DE | 199 39 428 | A1 | 3/2001 |
| DE | 199 52 512 | A1 | 5/2001 |
| DE | 100 02 273 | A1 | 8/2001 |
| EP | 0 548 916 | A1 | 6/1993 |
| JP | 60-243345 | | 12/1985 |

* cited by examiner

*Primary Examiner*—Davis D Hwu
(74) *Attorney, Agent, or Firm*—Ronald E. Greigg

(57) ABSTRACT

A fuel injection system for internal combustion engines, having a fuel injection nozzle supplied with fuel by a high-pressure fuel source, which fuel injection nozzle has a movable nozzle piston for opening and closing injection openings, an injection nozzle high-pressure chamber, and an injection nozzle control chamber. A pressure boosting device connected between the fuel injection nozzle and the high-pressure fuel source has a movable piston, a work chamber, and a high-pressure chamber, in which a filling connection which is open for filling the high-pressure chamber when the fuel injection nozzle is closed and is itself closed when the fuel injection nozzle is open.

11 Claims, 4 Drawing Sheets

FUEL INJECTION SYSTEM FOR INTERNAL COMBUSTION ENGINES

CROSS-REFERENCE TO RELATED APPLICATIONS

This application is a 35 USC 371 application of PCT/DE 03/02174 filed on Jun. 30, 2003.

BACKGROUND OF THE INVENTION

1. Field of the Invention

The common rail injection system serves to inject fuel into direct-injection internal combustion engines. In this common rail injection system, pressure generation and injection are decoupled from one another both in time and place. A separate high-pressure pump generates the injection pressure in a central high-pressure fuel reservoir. The onset of injection and the injection quantity are determined by the triggering time and triggering duration of injectors, actuated electrically, for instance, which communicate with the high-pressure fuel reservoir via fuel lines. In the common rail injection system, it is advantageous that the injection pressure is adapted to the load and rpm. The fuel injection is done at as high an injection pressure as possible. A high injection pressure has the advantages for instance of reduced pollutant emissions, reduced fuel consumption, and high specific outputs. The maximum injection pressures in common rail injection systems are limited to approximately 1800 bar by the high-pressure strength of pressure reservoirs (rails) and high-pressure pumps. For further increasing the injection pressure, a pressure booster can be employed in the injector. By means of a hydraulic boosting, the pressure booster converts a primary pressure, made available by the pressure reservoir, into the desired high injection pressure.

2. Prior Art

From German Patent Disclosure DE 4311627 A1, a fuel injection system is known in which the injection valves, to increase the injection pressure to up to 2000 bar, have a pressure booster. As a consequence of the reciprocating motion of a booster piston, the fuel pressure in an injection pressure chamber increases to a multiple of the high pressure applied. After the injection of fuel from the injection pressure chamber into a combustion chamber, the pressure in the injection pressure chamber drops as a result of the restoration of the booster piston. As a result, a check valve opens, so that fuel at the applied high pressure can flow into the injection pressure chamber (refilling). However, integrating such a check valve into a fuel injection system means considerable effort and expense in terms of production. It is difficult to accommodate the check valve in the installation space available.

SUMMARY OF THE INVENTION

The fuel injection system of the invention avoids the disadvantages of the prior art and makes it possible, at reduced production effort and expense, to assure refilling of the pressure booster. Advantageously, accommodating a check valve for this purpose is no longer necessary in the fuel injection system of the invention.

These advantages are attained according to the invention by a fuel injection system for internal combustion engines, having a fuel injection nozzle, which can be supplied with fuel by a high-pressure fuel source, which fuel injection nozzle has a movable nozzle piston for opening and closing injection openings, an injection nozzle high-pressure chamber, and an injection nozzle control chamber, and a pressure boosting device is connected between the fuel injection nozzle and the high-pressure fuel source and has a movable pressure booster piston, a pressure booster work chamber, and a pressure booster high-pressure chamber, in which a filling connection which is open for filling the pressure booster high-pressure chamber when the fuel injection nozzle is closed is itself closed when the fuel injection nozzle is open.

The closure of the filling connection that is open upon filling is coupled here with the motion of the nozzle piston in the opening direction to uncover the injection openings.

In a preferred embodiment of the present invention, when the fuel injection nozzle is open the filling connection is closed by the nozzle piston.

Because the nozzle piston for instance closes the filling connection while the fuel injection nozzle is open during the fuel injection and uncovers it again after the fuel injection with the fuel injection nozzle closed, no check valve is needed for filling the pressure booster high-pressure chamber upon the restoration of the pressure booster piston.

Preferably, in the fuel injection system of the invention, a pressure change in a pressure booster control chamber contained in the pressure boosting device and/or in the pressure booster work chamber causes a pressure change in the pressure booster high-pressure chamber. During the fuel injection, by means of its stroke, the pressure booster piston compresses the fuel in the pressure booster high-pressure chamber to a high injection pressure that is higher than the high fuel pressure in the high-pressure fuel source. When the fuel injection nozzle is open, fuel is injected at high injection pressure through the injection openings into the combustion chamber of the engine.

In a preferred embodiment of the present invention, the opening and closing of the injection openings is controllable via a control valve. This is preferably a 3/2-way valve. In a pressure-controlled fuel injector, for instance, the control valve can bring about the opening and closing of the injection openings by triggering the pressure boosting device.

BRIEF DESCRIPTION OF THE DRAWINGS

The invention will be described in further detail below in conjunction with the drawings, in which.

DESCRIPTION OF THE PREFERRED EMBODIMENTS

Figure 1:
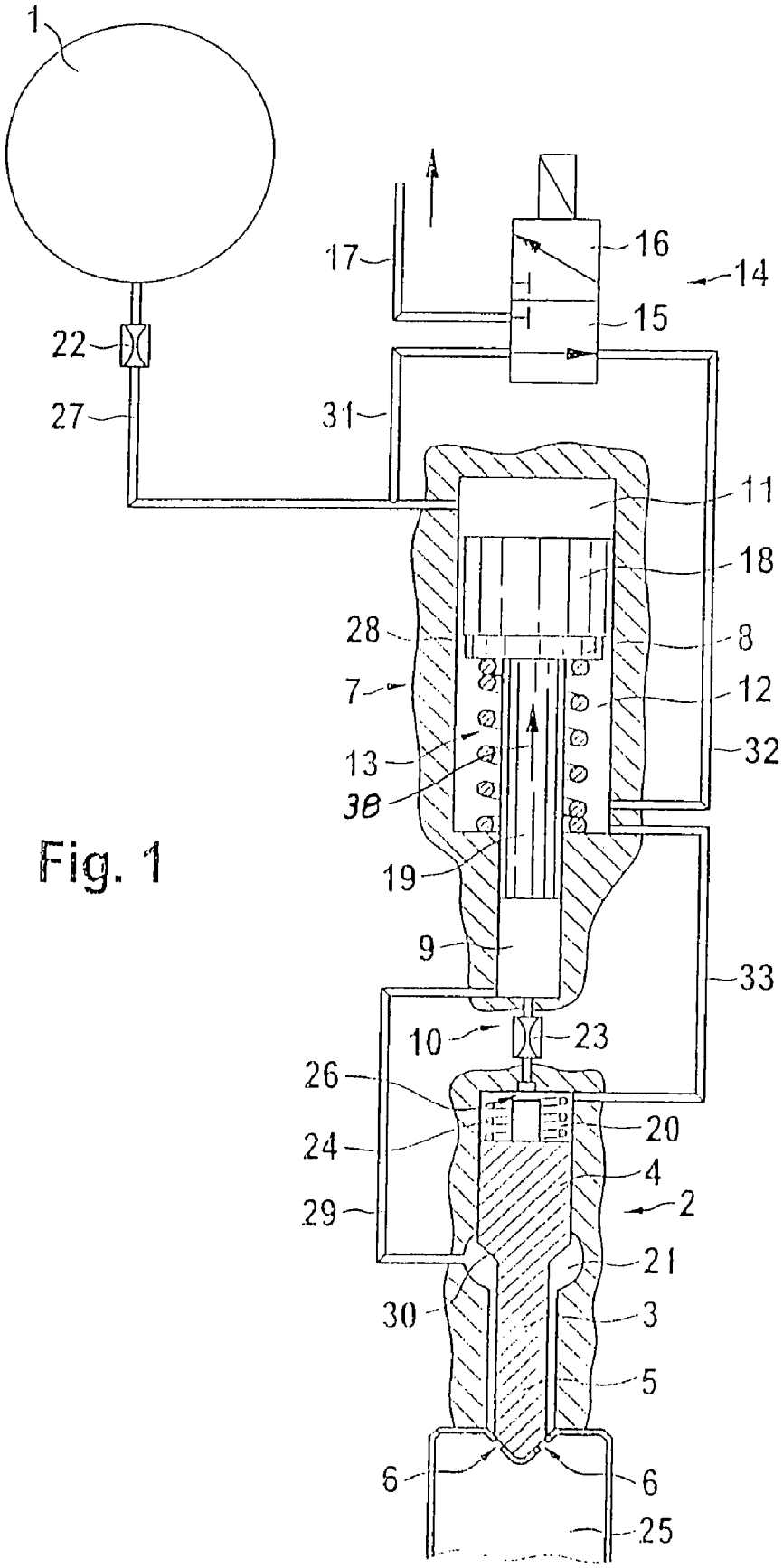
FIG. 1 is a hydraulic circuit diagram of a fuel injection system of the invention in the state of repose and upon restoration.

FIG. 1 shows a hydraulic circuit diagram of a fuel injection system of the invention in the state of repose and upon restoration. The system includes a high-pressure fuel source 1, for instance a pressure reservoir (common rail), which stores fuel compressed by a high-pressure pump to up to 1600 bar. From the high-pressure fuel source 1, the fuel is carried via a high-pressure line 27 to the injectors, which each include one control valve 14, one pressure boosting device 7, and one fuel injection nozzle 2.

In this preferred embodiment of the present invention, the control valve 14 is a 3/2-way valve. In FIG. 1, the control valve 14 is in a first switching position 15, in which the high-pressure line 27 is open toward a pressure booster control chamber 12 of the pressure boosting device 7, and a low-pressure line 17 leading to a low-pressure system, not further shown, is closed. In the second switching position 16 (not shown in FIG. 1), the control valve 14 closes the communication between the high-pressure line 27 and the pressure booster control chamber 12 and establishes a communication between the pressure booster control chamber 12 and the low-pressure line 17. The control valve 14 may for example be a piezoelectric or magnet valve. By using a fast-switching piezoelectric valve as the control valve, it is possible even at high nozzle opening pressure to inject small injection quantities in a defined way and with only slight tolerances in terms of quantity into the combustion chamber 25 of the engine. Moreover, because of the fast switching, only slight leakage losses occur. In addition, the control valve 14 may be embodied as a directly controlled valve or as a servo valve.

The pressure boosting device 7 includes a pressure booster piston 8, which is resiliently supported by means of a restoring spring 13. The pressure booster piston 8 divides a pressure booster high-pressure chamber 9 from a pressure booster work chamber 11, which is connected to the high-pressure fuel source via the high-pressure line 27. The restoring spring 13 used to support the pressure booster piston 8 is located in the pressure booster control chamber 12. The pressure booster piston 8 can be divided into two regions: a first (larger-diameter) pressure booster piston region 18 and a second (smaller-diameter) pressure booster piston region 19. The two pressure booster piston regions 18, 19 are separate components, but may also be solidly joined to one another or may be embodied as a single component. The housing 28 of the pressure boosting device 7 has a steplike tapering. The interior of the pressure boosting device 7 is divided up, by the first pressure booster piston region 18 of the pressure booster piston 8 that is located displaceably in the housing 28, into two regions, which are separated from one another in fluid-tight fashion except for leakage losses. One region is the pressure booster work chamber 11, which communicates with the high-pressure fuel source 1 via the high-pressure line 27, and the second region has the aforementioned steplike tapering, into which the second pressure booster piston region 19 protrudes displaceably. As a result, the tapered region is demarcated in fluid-tight fashion from the remainder of the second region, so that a pressure booster control chamber 12 and a pressure booster high-pressure chamber 9 are formed. The pressure booster work chamber 11 communicates with the high-pressure fuel source 1 via the high-pressure line 27. The pressure booster control chamber 12 can be made to communicate, via the control valve 14, with either the high-pressure fuel source 1 (first switching position 15) or the low-pressure line 17 (second switching position 16). The pressure booster high-pressure chamber 9 communicates via a high-pressure injection line 29 with an injection nozzle high-pressure chamber 21 of the fuel injection nozzle 2 and can be made to communicate, via a filling connection 10, with an injection nozzle control chamber 20 that is included in the fuel injection nozzle 2. In this preferred embodiment of the present invention, the filling connection 10 is located between the pressure booster high-pressure chamber 9 and the injection nozzle control chamber 20. The filling connection 10 preferably includes a throttle 23.

The fuel injection nozzle 2 includes a nozzle piston 3 and, with its injection openings 6, protrudes into the combustion chamber 25 of a cylinder of an internal combustion engine. The nozzle piston 3 can be divided into two regions: the upper (larger-diameter) nozzle piston region 4 and the (smaller-diameter) nozzle needle 5; the upper nozzle piston region 4 merges with the nozzle needle 5 via a pressure shoulder 30. In the region of the pressure shoulder 30, the nozzle piston 3 is surrounded by the injection nozzle high-pressure chamber 21.

In the state of repose (FIG. 1), the control valve 14 is not triggered (first switching position 15), and no injection takes place. In this preferred embodiment of the present invention, the pressure booster high-pressure chamber 9, with the fuel injection nozzle 2 closed, communicates with the high-pressure fuel source 1 via the control valve 14 (in a first switching position 15), the pressure booster control chamber 12, the injection nozzle chamber 20, and the filling connection 10. The high pressure of the high-pressure fuel source 1 is then present at the following places:

- in the high-pressure line 27,
- in the pressure booster work chamber 11,
- via the high-pressure connecting line 31 at the control valve 14,
- via the first connecting line 32 in the pressure booster control chamber 12,
- via the second connecting line 33 in the injection nozzle control chamber 20,
- via the filling connection 10 in the pressure booster high-pressure chamber 9, and
- via the high-pressure injection line 29 in the injection nozzle high-pressure chamber 21.

Thus in the state of repose, all the pressure chambers (11, 12, 9) of the pressure boosting device 7 are acted upon by high pressure, and the pressure booster piston 8 is pressure-balanced. The pressure boosting device 7 is deactivated, and no pressure boosting occurs. Via the restoring spring 13, the pressure booster piston 8 is kept in its outset position. The high pressure in the injection nozzle control chamber 20 exerts a hydraulic closing force on the nozzle piston 3, which keeps the fuel injection nozzle 2 closed, together with the closing force of the closing spring 24. These two forces together are greater than the hydraulic force acting in the opening direction on the nozzle piston 3 in the injection nozzle high-pressure chamber 21, and so despite the high pressure that constantly prevails in the injection nozzle high-pressure chamber 21, the injection openings remain closed by the nozzle needle 5. Consequently, no injection takes place.

Figure 2:
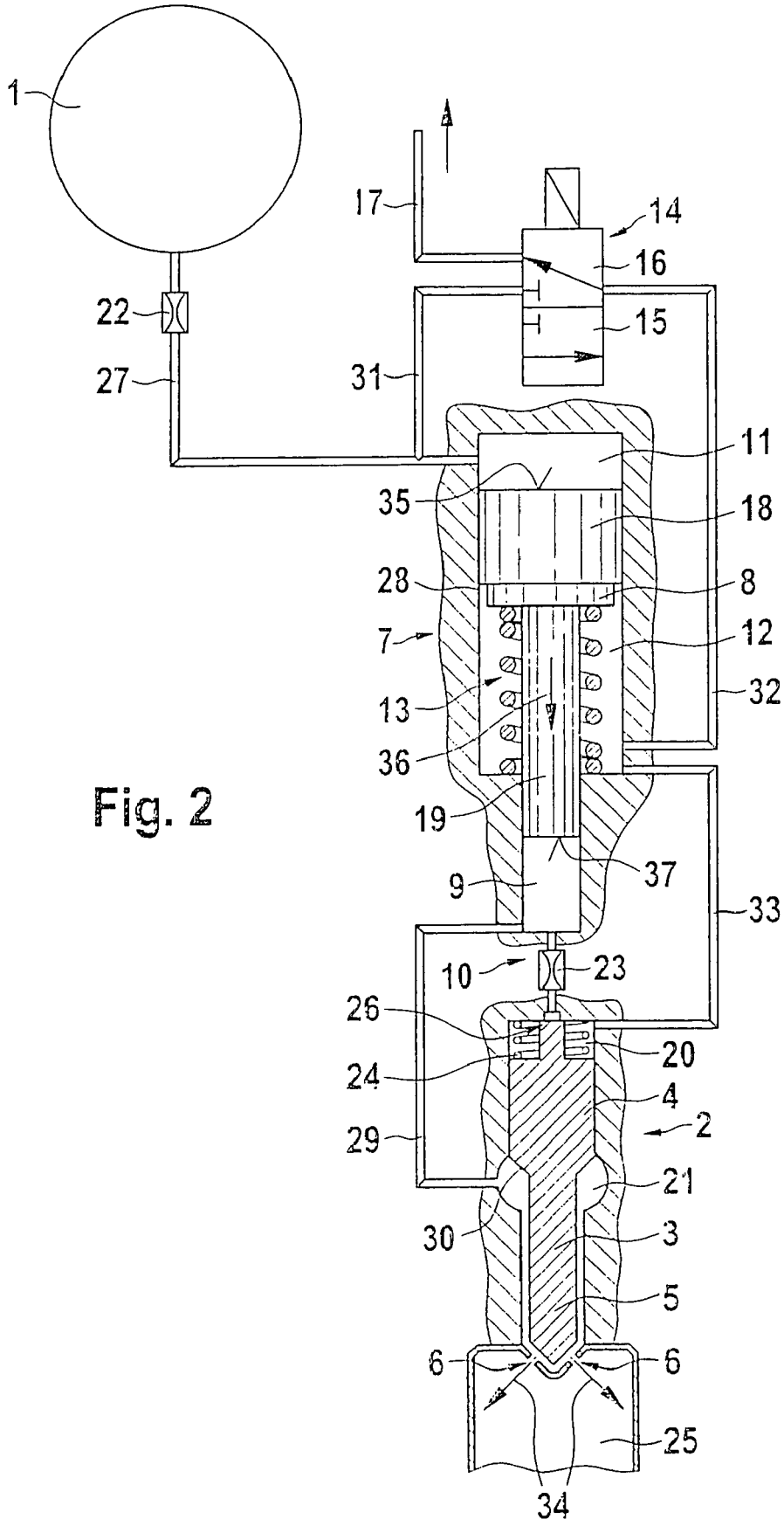
FIG. 2 is a hydraulic circuit diagram of a fuel injection system of the invention upon injection.

FIG. 2 shows a hydraulic circuit diagram of a fuel injection system of the invention upon injection.

The makeup of the fuel injection system shown in FIG. 2 is equivalent to that of FIG. 1. The injection of fuel into the combustion chamber 25 is initiated by the activation of the 3/2-way control valve 14. A switchover is made from the first switching position 15 (communication of the pressure booster control chamber 12 with the high-pressure fuel source 1 via the first connecting line 32, the high-pressure connecting line 31, and the high-pressure line 27) to the second switching position 16. In the second switching position 16, the pressure booster control chamber 12 communicates with the low-pressure line 17. A pressure relief of the pressure booster control chamber 12 thus occurs, and as a result the pressure boosting device 7 is activated. Simultaneously, the injection nozzle control chamber 20 is also pressure-relieved.

In the preferred embodiment of the present invention shown in FIG. 2, the high-pressure fuel source 1 communicates (including during the injection) via a high-pressure line 27 with the pressure booster work chamber that is included in the pressure boosting device 7. In the pressure booster work chamber 11, the high pressure from the high-pressure fuel source 1 acts in the compression direction 36 on the large piston face 35 of the first pressure booster piston region 18. Only the low pressure in the pressure booster control chamber 12, the force of the restoring spring 13, and the high pressure in the pressure booster high-pressure chamber 9 act counter to the compression direction 36. The force in the compression direction 36 predominates. The pressure booster piston 8 therefore moves in the compression direction 36 in the housing 28 of the pressure boosting device 7 and compresses the fuel in the pressure booster high-pressure chamber 9 and thus also increases the pressure in the injection nozzle high-pressure chamber 21. As a result of the pressure difference between the injection nozzle high-pressure chamber 21 and the injection nozzle control chamber 20, the nozzle piston 3 moves in the opening direction counter to the closing force of the closing spring 24 and uncovers the injection openings 6. Fuel 34 is now injected into the combustion chamber 25 at an increased pressure, compared to the pressure in the high-pressure fuel source 1, by means of the pressure boosting device 7.

In the open state of the fuel injection nozzle 2, the filling connection 10 between the injection nozzle control chamber 20 and the pressure booster high-pressure chamber 9 is closed by the nozzle piston 3. One end of the nozzle piston 3 cooperates with the sealing seat 26. During the injection, no lost quantity from the pressure booster high-pressure chamber can consequently escape via the throttle 23 included in the filling connection 10.

As long as the pressure booster control chamber 12 is pressure-relieved, the pressure boosting device 7 remains activated, and the pressure booster piston 8 compresses the fuel in the pressure booster high-pressure chamber 9. The compressed fuel is carried onward to the nozzle needle 5 and injected into the combustion chamber 25.

For terminating the injection, the control valve is switched back into the first switching position 15 (FIG. 1), so that the pressure booster control chamber 12 and the injection nozzle chamber 20 can be disconnected from the low-pressure line 17 and made to communicate with the high-pressure fuel source 1. In the pressure booster control chamber 12, the high pressure builds up again as a result. In the pressure booster high-pressure chamber 9, the pressure drops to the high pressure generated by the high-pressure fuel source 1. The pressure booster piston 8 is now hydraulically balanced.

In the injection nozzle control chamber 20 and in the injection nozzle high-pressure chamber 21, the high pressure from the high-pressure fuel source also builds up, so that the nozzle piston 3 of the fuel injection nozzle 2 is also hydraulically balanced. The nozzle piston 3 is then moved in the closing direction by the force of the closing spring 24, until the injection openings 6 are closed by the nozzle needle 5. The injection is terminated, and the filling connection 10 is uncovered again by the motion of the nozzle piston 3 in the closing direction.

After the pressure equalization of the system, the pressure booster piston 8 is moved in the restoring direction 38 by the force of the restoring spring 13, until it has been restored to its outset position. In the process, the pressure booster high-pressure chamber 9 is refilled from the injection nozzle control chamber 20, via the throttle 23 contained in the filling connection 10. The filling takes place automatically, without requiring an additional check valve.

For stabilizing the switching sequences, still further provisions may be made for damping fluctuations between the high-pressure fuel source 1 and the injector. This can be done for instance by means of an optimized design of a throttle 22 in the high-pressure line 27. Alternatively, a throttle check valve (not shown) may be inserted at an arbitrary point in the supply line (27, 31, 32).

Figure 3:
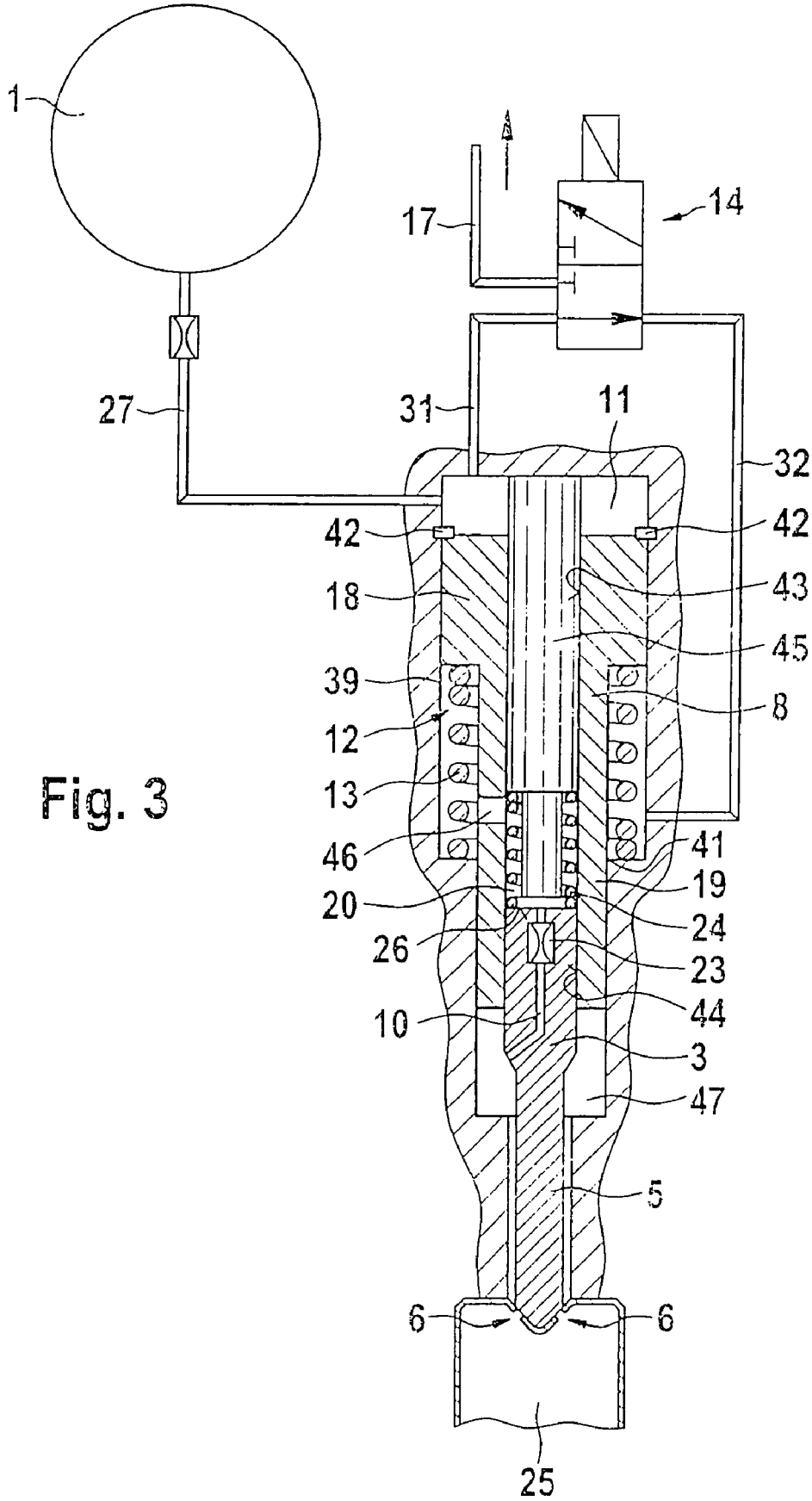
FIG. 3 is a fuel injection system of the invention in a coaxial construction.

FIG. 3 shows a fuel injection system of the invention of coaxial construction. Here, the pressure boosting device and the fuel injection nozzle are located coaxially to one another in a common injector housing 39. In the injector housing 39, two parts movable relative to one another are resiliently supported: a pressure booster piston 8 and a nozzle piston 3. The pressure booster piston 8 has a first (larger-diameter) pressure booster piston region 18 and a second (smaller-diameter) pressure booster piston region 19. The injector housing 39 likewise has a steplike tapering 41. The (larger-diameter) first pressure booster piston region 18 is guided axially and largely in fluid-tight fashion by the larger-diameter part of the injector housing 39. The (smaller-diameter) second pressure booster piston region 19 is located partly in the larger-diameter part of the injector housing 39 and plunges partway into the smaller-diameter part of the injector, where it is guided axially displaceably and in largely fluid-tight fashion. The larger-diameter first pressure booster piston region 18 separates the pressure booster work chamber 11 and the pressure booster control chamber 12 from one another in the interior of the injector housing 39. The restoring spring 13 surrounding the smaller-diameter second pressure booster piston region 19 is located in the pressure booster control chamber 12. The restoring spring 13 is braced by one end in the region of the steplike tapering 41 of the injector housing 39 and on the other on the larger-diameter first pressure booster piston region 18. In the state of repose, it presses the pressure booster piston 8 into its position of repose against a limiting element 42 located in the injector housing 39. The pressure booster piston 8 is embodied as a hollow piston: It includes a central through bore 43. The nozzle piston 3 is guided in largely fluid-tight fashion in a guidance region 44 in this bore 43.

In the region of the pressure booster work chamber 11, a pressure piece 45 protruding in the form of a cylinder into the bore 43 is secured to the injector housing 39. On the side toward the nozzle piston 3, the pressure piece 45 has a taper, over which a closing spring 24 is pulled. The closing spring 24 is braced on one end against the pressure piece 45 and on the other presses against the end, protruding into the bore 42, of the nozzle piston 3. Between the nozzle piston 3 and the pressure piece 45, there is enough free space to allow lifting of the nozzle needle 5 from the injection openings 6, counter to the force of the closing spring 24, during an injection event.

The closing spring 24 is surrounded in the bore 43 by the injection nozzle control chamber 20. In the preferred embodiment of the present invention shown in FIG. 3, the injection nozzle control chamber 20 is thus located in the pressure booster piston 8, which is embodied as a hollow piston. The pressure booster piston 8 includes at least one opening 46, by way of which the injection nozzle control chamber 20 communicates continuously with the pressure booster control chamber 12, so that the pressure in the two chambers 12, 20 is always balanced.

As an alternative to this, the injection nozzle control chamber 20 could communicate, instead of with the pressure booster control chamber 12, with the pressure booster work chamber 11, for instance. In that case, the injection nozzle control chamber 20 is not relieved jointly with the pressure booster control chamber 12 but instead remains constantly at the pressure level of the work chamber 11. This would be equally possible, since in the injection nozzle high-pressure chamber 21, a higher pressure is built up by the pressure boosting device 7, and the fuel injection nozzle 2 thus opens.

For causing the injection nozzle control chamber 20 to communicate with the pressure booster work chamber 11, the pressure piece 45 could for instance be reduced in diameter, so that it would no longer be guided in the pressure booster piston 8 in a high-pressure-proof fashion; instead, there would be a communication between the two chambers 20, 11 along the pressure piece 45.

In the arrangement shown in FIG. 3, the pressure booster high-pressure chamber 9 and the injection nozzle high-pressure chamber 21 of FIGS. 1 and 2 coincide and are formed by the high-pressure chamber 47. The filling connection 10, including a throttle 23, between the injection nozzle control chamber 20 and the high-pressure chamber 47, in this preferred embodiment of the present invention, extends in the nozzle piston 3.

The metering of the fuel into the combustion chamber 25 is again done by activation of the 3/2-way control valve 14. As a result, the pressure booster control chamber 12 is made to communicate with the low-pressure line 17 via the connecting line 32 and is thus pressure-relieved. This activates the pressure boosting device, and the fuel is compressed in the high-pressure chamber 47 by the pressure booster piston 8. The compressed fuel is carried onward along the nozzle needle 5. Finally, as a consequence of the increasing opening pressure force in the high-pressure chamber 47, the nozzle piston 3 uncovers the injection openings 6, and the fuel is injected into the combustion chamber 25. With the fuel injection nozzle open, the nozzle piston 3 rests with the sealing seat 26 on the pressure piece 45 and thus closes the filling connection 10 in a fluid-proof fashion. Hence no compressed fuel can flow back into the injection nozzle control chamber 20 from the high-pressure chamber 47.

For terminating the injection, the pressure booster control chamber 12 is made to communicate with high-pressure fuel source 1 again by means of the control valve 14. As a result, the high fuel pressure generated by the high-pressure fuel source builds up in the pressure booster control chamber 12 and, via the opening 46, in the injection nozzle control chamber 20. The pressure in the high-pressure chamber 47 drops to the high pressure of the high-pressure fuel source, whereupon the pressure booster piston 8 is hydraulically balanced, as is the nozzle piston 3. By the force of the springs 13, 24, both piston 3, 8 are moved into their respective positions of repose. The nozzle needle closes the injection openings 6, and the nozzle piston 3 lifts the sealing seat 26 from the pressure piece 45. The filling connection 10 is thus opened, so that the high-pressure chamber 47 communicates with the high-pressure fuel source 1, via the filling connection 10 and further chambers 20, 12 and connections 46, 32, 31, 27. Thus the high-pressure chamber 47 is filled via the filling connection 10 upon restoration of the pressure booster piston 8.

As a result of the combination of the pressure booster high-pressure chamber and the injection nozzle high-pressure chamber, the pressure booster piston embodied as a hollow piston, and the filling connection included in the nozzle piston, an especially compact construction of the fuel injection system can advantageously be achieved in this preferred embodiment of the present invention.

Figure 4:
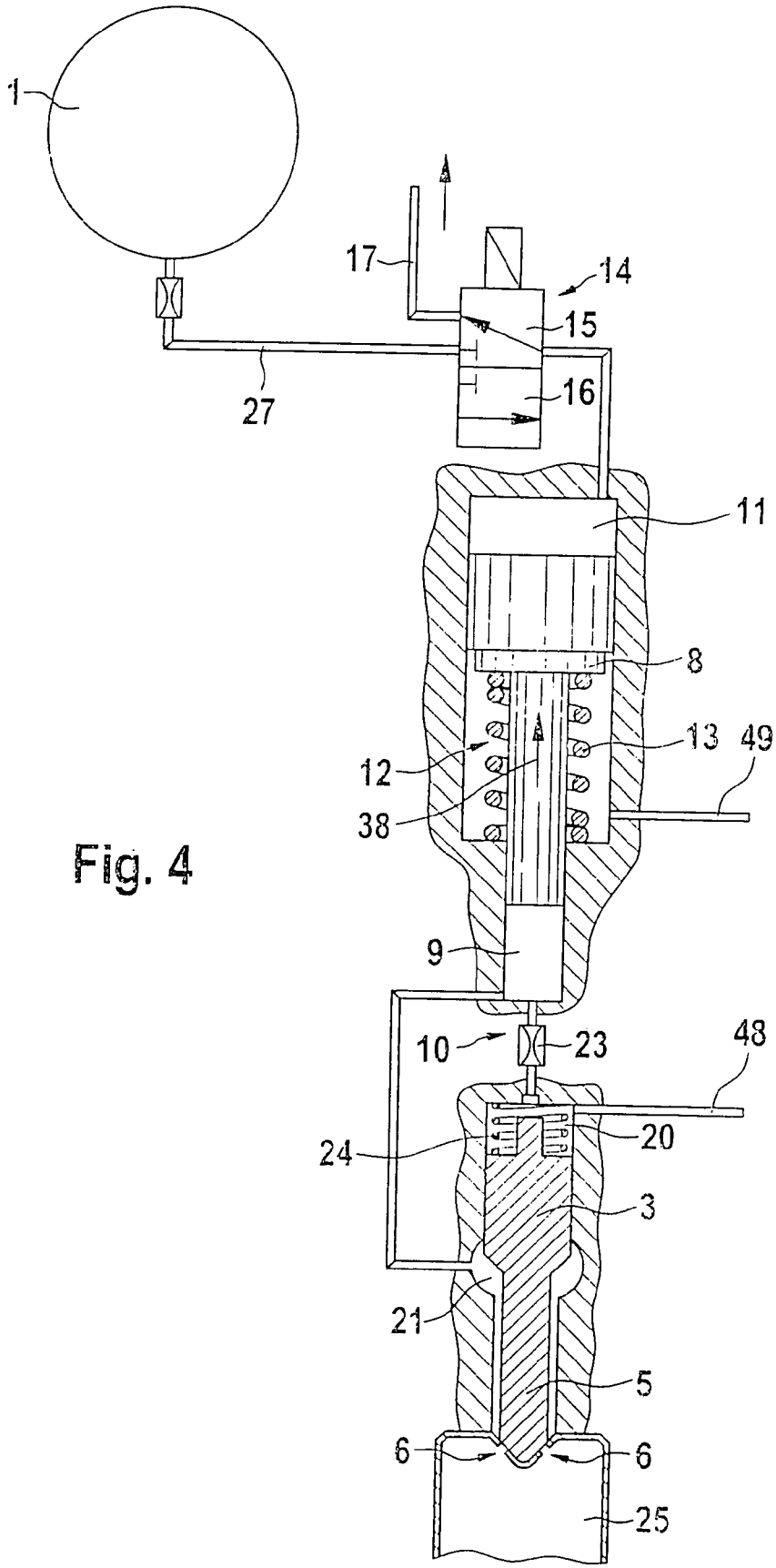
FIG. 4 is a diagram of a further embodiment of a fuel injection system of the invention in the state of repose and upon filling.

FIG. 4 shows a further preferred embodiment of a fuel injection system of the invention in the state of repose and upon filling.

In the state of repose (no injection), the control valve 14 is located in a first switching position 15, in which it connects the pressure booster work chamber 11 with the low-pressure line 17. Both the injection nozzle control chamber 20 and the pressure booster high-pressure chamber 9, the latter thus communicating in the state of repose via the filling connection 10, and the injection nozzle high-pressure chamber 21 all communicate, via a second low-pressure line 48, with a low-pressure side not otherwise shown, as does the pressure booster control chamber 12 via a third low-pressure line 49. In this preferred embodiment of the present invention, when the fuel injection nozzle 2 is closed, the pressure booster high-pressure chamber 9, via the filling connection 10, and via the injection nozzle control chamber 20, the pressure booster control chamber 12 and the pressure booster work chamber 11 communicate with at least one low-pressure line 17, 48, 49. Thus both the pressure booster piston 8 and the nozzle piston 3 are hydraulically balanced in the state of repose, and both pistons 8, 3 are kept in their position of repose, each by its associated spring 13, 24. The injection openings 6 are closed toward the combustion chamber 25 by the nozzle needle 5.

For injection, the control valve 14 is switched from the first switching position 15 to the second switching position 16. In the second switching position 16, the pressure booster work chamber 11 communicates with the high-pressure fuel source 1. In the pressure booster work chamber 11, the pressure generated by the high-pressure fuel source 1 builds up. As a result, the pressure booster piston 8 moves in the compression direction and compresses the fuel in the pressure booster high-pressure chamber 9 to boosted pressure. This boosted pressure is carried onward into the injection nozzle high-pressure chamber 21. The nozzle piston 3 moves in the opening direction as a result of the pressure force thus generated and uncovers the injection openings 6. Simultaneously, the filling connection 10 from the pressure booster high-pressure chamber 9 to the injection nozzle control chamber 20 is closed by the nozzle piston 3. Thus no lost quantity occurs during the injection.

For terminating the injection event, the control valve 14 is switched back to the first switching position 15. The pressure booster work chamber 11 then communicates with the low-pressure line 17 again. The low pressure is likewise established in the pressure booster high-pressure chamber 9 and consequently in the injection nozzle high-pressure chamber 21 as well. The nozzle needle 5 therefore closes, and the nozzle piston 3 uncovers the filling connection 10. The pressure booster high-pressure chamber 9 is filled from the low-pressure system via the filling connection 10 upon the restoration 38 of the pressure booster piston 8. The filling connection 10 may if need be include a throttle 23.

The foregoing relates to a preferred exemplary embodiments of the invention, it being understood that other variants and embodiments thereof are possible within the spirit and scope of the invention, the latter being defined by the appended claims.

The invention claimed is:

1. A fuel injection system for internal combustion engines, comprising a fuel injection nozzle (2), which can be supplied with fuel by a high-pressure fuel source (1), the fuel injection nozzle (2) having a movable nozzle piston (3) for opening and closing injection openings (6), an injection nozzle high-pressure chamber (21), an injection nozzle control chamber (20), and a closing spring located within the control chamber (20) for biasing the nozzle piston (3) in a direction to close the injection openings (6), a pressure boosting device (7) is connected between the fuel injection nozzle (2) and the high-pressure fuel source (1), the pressure boosting device (7) having a movable pressure booster piston (8), a pressure booster work chamber (11), and a pressure booster high-pressure chamber (9), and a filling connection (10) which is open for filling the pressure booster high-pressure chamber (9) when the fuel injection nozzle (2) is closed and is itself closed by the nozzle piston (3) when the fuel injection nozzle (2) is open, said filling connection (10) including a throttle (23), wherein closure of the filling connection (10) is coupled with the motion of the nozzle piston (3) in the opening direction to uncover the injection openings, and wherein the control chamber (20) is hydraulically connected to the pressure booster high-pressure chamber (9) by the filling connection (10).

2. The fuel injection system of claim 1, wherein a pressure change in a pressure booster control chamber (12) contained in the pressure boosting device (7) and/or in the pressure booster work chamber (11) causes a pressure change in the pressure booster high-pressure chamber (9).

3. The fuel injection system of claim 2, wherein the pressure booster high-pressure chamber (9) communicates, when the fuel injection nozzle (2) is closed, with the high-pressure fuel source (1) via a control valve (14) (in a first switching position (15)), the pressure booster control chamber (12), the injection nozzle control chamber (20), and the filling connection (10).

4. The fuel injection system of claim 2, wherein when the fuel injection nozzle (2) is opening and is open, the pressure booster control chamber (12) and the injection nozzle control chamber (20) communicate with a low-pressure line (17).

5. The fuel injection system of claim 2, wherein when the fuel injection nozzle (2) is closed, the pressure booster high-pressure chamber (9), via the filling connection (10), and via the injection nozzle control chamber (20), the pressure booster control chamber (12) and the pressure booster work chamber (11) communicate with at least one low-pressure line (17, 48, 49).

6. The fuel injection system of claim 1, further comprising a control valve (14) operable to control the opening and closing of the injection openings (6) are controllable via a control valve (14).

7. The fuel injection system of claim 1, wherein the high-pressure fuel source (1) communicates during the injection, via a high-pressure line (27), with the pressure booster work chamber (11) contained in the pressure boosting device (7).

8. The fuel injection system of claim 1, wherein the filling connection (10) is closable by the cooperation of the nozzle piston (3) with a sealing seat (26).

9. The fuel injection system of claim 1, further comprising a sealing seat (26) embodied on the nozzle piston (3) and cooperating with a pressure piece (45) for closing the filling connection (10).

10. The fuel injection system of claim 1, wherein the filling connection (10) is embodied in the nozzle piston (3).

11. The fuel injection system of claim 1, wherein the injection nozzle control chamber (20) is located in the pressure booster piston (8), and wherein the pressure booster piston (8) is embodied as a hollow piston.

* * * * *